US008677883B2

(12) United States Patent
Wössner et al.

(10) Patent No.: US 8,677,883 B2
(45) Date of Patent: Mar. 25, 2014

(54) ROTARY LUG BREECHES AND WEAPONS INCLUDING SUCH ROTARY LUG BREECHES

(75) Inventors: Ernst Wössner, Oberndorf (DE); Stefan Doll, Oberndorf (DE); Martin Stussak, Oberndorf (DE)

(73) Assignee: Heckler & Koch GmbH, Oberndorf (DE)

( * ) Notice: Subject to any disclaimer, the term of this patent is extended or adjusted under 35 U.S.C. 154(b) by 0 days.

(21) Appl. No.: 13/594,465

(22) Filed: Aug. 24, 2012

(65) Prior Publication Data

US 2013/0074390 A1 Mar. 28, 2013

Related U.S. Application Data

(63) Continuation of application No. PCT/EP2011/000718, filed on Feb. 15, 2011.

(30) Foreign Application Priority Data

Feb. 26, 2010 (DE) ..... 10 2010 009 427

(51) Int. Cl.
*F41A 3/26* (2006.01)

(52) U.S. Cl.
USPC ..... 89/185; 89/188

(58) Field of Classification Search
USPC ..... 89/9, 11, 180, 185, 188; 42/16
See application file for complete search history.

(56) References Cited

U.S. PATENT DOCUMENTS 1,907,164 A 5/1933 White
2,308,627 A 1/1943 Rickenbacher
2,364,548 A 12/1944 Pederson
2,775,920 A 1/1957 Dixon et al.
2,941,449 A * 6/1960 Reed ..... 89/185
3,030,723 A 4/1962 Ivy (Continued)

FOREIGN PATENT DOCUMENTS

CH 51131 8/1911
DE 419803 10/1925

(Continued)

OTHER PUBLICATIONS

International Searching Authority, "Search Report," issued in connection with International Application No. PCT/EP2011/000718, mailed on Jun. 6, 2011, 2 pages.

(Continued)

*Primary Examiner* — Gabriel Klein

(74) *Attorney, Agent, or Firm* — Hanley, Flight and Zimmerman, LLC

(57) ABSTRACT

Rotary lug breeches and weapons including such rotary lug breeches are disclosed. An example rotary lug breech includes a bolt carrier. Wherein when releasing the bolt, a cam section of a receiver converts a releasing motion into a screwing motion to release a cartridge. During the screwing motion, a first stud surface interacts with the cam section. During a locking process, the first stud surface engages the cam section to perform a pre-control process that rotates a control pin in a slot from a releasing position in which an advancement of the bolt carrier exerts substantially no torque on the bolt, to a control position in which a first slot surface of the slot interacts with the control pin. When the bolt carrier moves forward, the bolt carrier exerts a torque on the bolt to enable the bolt and the bolt carrier move relative to one another.

19 Claims, 9 Drawing Sheets

(56) References Cited

U.S. PATENT DOCUMENTS

| | | | | | |
|---|---|---|---|---|---|
| 3,198,076 | A | * | 8/1965 | Stoner | 89/128 |
| 3,342,171 | A | | 9/1967 | Ryan et al. | |
| 3,830,003 | A | | 8/1974 | Clerke | |
| 3,996,684 | A | * | 12/1976 | Bauman et al. | 42/16 |
| 4,315,379 | A | | 2/1982 | Lang | |
| 4,389,919 | A | * | 6/1983 | Kast et al. | 89/185 |
| 4,463,654 | A | | 8/1984 | Barnes et al. | |
| 4,553,469 | A | | 11/1985 | Atchisson | |
| 4,596,084 | A | | 6/1986 | Martial | |
| 4,655,118 | A | | 4/1987 | Bruderer et al. | |
| 4,663,876 | A | | 5/1987 | Reaume | |
| 4,872,391 | A | | 10/1989 | Stoner | |
| 4,920,855 | A | * | 5/1990 | Waters | 89/172 |
| 4,930,399 | A | | 6/1990 | Trevor, Jr. | |
| 5,440,099 | A | | 8/1995 | Smith | |
| 5,580,474 | A | | 12/1996 | Smith | |
| 5,722,194 | A | | 3/1998 | Wurger et al. | |
| 5,920,028 | A | * | 7/1999 | Guhring et al. | 89/188 |
| 8,459,165 | B2 | * | 6/2013 | Doll et al. | 89/17 |
| 2003/0196366 | A1 | | 10/2003 | Beretta | |
| 2009/0031607 | A1 | | 2/2009 | Robinson et al. | |
| 2010/0005956 | A1 | * | 1/2010 | Wossner | 89/188 |
| 2011/0016009 | A1 | | 1/2011 | Mehew et al. | |
| 2011/0023694 | A1 | | 2/2011 | Haywood | |
| 2012/0180646 | A1 | | 7/2012 | Wössner et al. | |

FOREIGN PATENT DOCUMENTS

| | | |
|---|---|---|
| DE | 19600459 | 7/1997 |
| DE | 102007011504 | 9/2008 |
| EP | 0188681 | 7/1986 |
| EP | 1357348 | 10/2003 |
| GB | 13946 | 0/1910 |
| GB | 572924 | 10/1945 |
| WO | 9703785 | 2/1997 |
| WO | 2008106697 | 9/2008 |
| WO | 2008147491 | 12/2008 |

OTHER PUBLICATIONS

International Searching Authority, "International Preliminary Report on Patentability," issued in connection with International Application No. PCT/EP2011/000718, mailed on Aug. 26, 2012, 24 pages.

International Searching Authority "Written Opinion," issued in connection with International Application No. PCT/EP2011/000717, mailed on May 30, 2011, 16 pages.

International Searching Authority "Search Report," issued in connection with International Application No. PCT/EP2011/000717, mailed on May 30, 2011, 4 pages.

United States Patent and Trademark Office, "Non-Final Office Action" issued in connection with U.S. Appl. No. 13/356,242, mailed on Dec. 7, 2012, 14 pages.

United States Patent and Trademark Office, "Notice of Allowance" issued in connection with U.S. Appl. No. 13/356,242, mailed on Jul. 9, 2013, 6 pages.

* cited by examiner

ROTARY LUG BREECHES AND WEAPONS INCLUDING SUCH ROTARY LUG BREECHES

RELATED APPLICATION

This patent is a continuation of International Patent Application Serial No.: PCT/EP2011/000718, filed Feb. 15, 2011, which claims priority to German Patent Application 10 2010 009 427.7, filed on Feb. 26, 2010, both of which are hereby incorporated herein by reference in their entireties.

FIELD OF THE DISCLOSURE

This patent relates generally to rotary lug breeches and, more specifically, to rotary lug breeches and weapons including such rotary lug breeches.

BACKGROUND

Rotary lug breeches safely secure a cartridge in a cartridge chamber of a muzzle and/or barrel prior to releasing a shot. To secure the base of the cartridge, a head is introduced into a bolt head and/or receiver and secured there by a rotational motion and/or interaction with a mounting socket and/or lugs. The locking lugs are radially disposed inwards of the receiver.

To retain the cartridge to be fired, breech lugs pass through and past gaps between the locking lugs in the bolt head toward the cartridge chamber. Bolt gaps are also formed that correspond to the locking lugs and/or rows of locking lugs of the bolt head through which the bolt can pass after the bolt has been inserted into the bolt head. To lock the breech, the bolt is subsequently rotated in the receiver to place the breech lugs rearwards of the locking lugs. Specifically, with the subsequent rotational motion of the bolt in the receiver, end rearward facing surfaces of the breech lugs are in front of end forward facing surfaces of the locking lugs.

With the cartridge secured, the cartridge may be fired and the resulting recoil forces directed through the impact base, the bolt, the breech and locking lugs to the receiver rigidly connected to the barrel. Directing the recoil forces through the impact base, the bolt, the breech and locking lugs to the receiver substantially prevents the breech from moving backwards in an undesired manner immediately after firing a shot.

With automatic weapons in which new ammunition is introduced via a breech configuration and/or assembly without manual reloading, the bolt is normally located in a bolt carrier. The bolt carrier is pushed forwards by a breech spring and, as a result of recoil effects, is rearwardly pushed by a propellant gas and rod (e.g., piston assembly) against the effect of a breech spring. The rotational motion for locking and releasing the bolt is obtained by a gate control (e.g., a slot). Based on movement of the bolt and/or bolt carrier, the gate control controls the relative movement and/or rotational movement of bolt and/or bolt carrier. Mauser MG 34, the MG4, and the SLB 2000 from Heckler & Koch, the assignee of the present patent, include rotatory lug breeches. Other rotary lug breeches are described in DE 196 00 459 or EP 0 188 681.

CH 51131 A1 describes a straight pull breech having locking lugs that include pitched breech surfaces that slide along corresponding locking niches on side walls. As the breech unit is released, the empty cartridge shells are also released.

DE 419803 A describes a recoil-control rotary lug breech in which rotational motion of the locking lugs are transferred to linear motion via a curved surface.

DE 196 00 459 A1 describes a rotary head breach in which the bolt has two rows of breech lugs lying in a row along the longitudinal axis. The lateral flanks of the breech lugs define a high-pitch thread along the longitudinal axis of the breech. There may be twelve lugs per row. Thus, in releasing and locking the bolt in the receiver, an interaction of the breech and locking lugs causes an additional rotational bolt motion, which locks or releases a control pin from a safety groove. The bolt is also provided with diagonal locking lugs. The safety groove runs radially or in a circumferential direction of a guide sleeve (e.g., bolt carrier).

U.S. Pat. No. 2,364,548 describes a gas-pressure operated rotary head breech in which two locking pins of the bolt and two L-shaped locking grooves and/or pockets in the receiver form a bayonet mount. The compulsory guide of the locking pins at the control surfaces enable corresponding guide surfaces in locking pockets of the receiver to have relatively high tolerances.

U.S. Pat. No. 2,775,920d describes a rotary breech head in which rotational motion of a bolt is initiated by relative motion between the bolt carrier and the bolt in the longitudinal direction. The relative motion is enabled by corresponding guide grooves and guide tracks provided with a pitch. The rotational motion is completed by inertia of the rotating bolt in the receiver. A screwing motion of the bolt is substantially prevented.

EP 0 188 681 describes using a rotary bolt having two rows of breech lugs lying behind one another in the longitudinal axis and the recoil effects of an advancing rotary lug breech toward a radial annular surface at a rear edge of the barrel to the breech lugs. The edges of the breech surfaces are rounded. As seen from the perspective of the shooter, the right-hand edge of the bolt surfaces are beveled. Beveling the bolt surfaces creates a safety clearance for the recoiling breech surfaces.

Rotary lug breeches are also used in machine guns in which the breech carries out propulsion functions including loading ammunition from a cartridge belt, removing and reliably discarding empty, fired cartridge shells and transporting the ammunition belt with cartridges relative to the firearm and/or breech. When the machine gun is cycled, substantial masses are moved back and forth in the weapon in the direction of firing and transverse to the direction of firing. The direction of firing is in the direction of the bore axis and the direction transverse to the direction of firing is in the direction of the operation of the cartridge belt feed. In cycling, the bolt rotationally moves back and forth quickly. If the firearm is fired at a higher cadence, substantial longitudinal, transversal and/or rotational accelerations occur that limit the aiming precision and cause manually loaded machine guns to stray when fired. If the firing cadence is reduced, thereby reducing the breech speed and/or acceleration, the operational forces needed to reload and feed ammunition may no longer be readily applied causing the weapon to fail.

DETAILED DESCRIPTION

Figure 1:
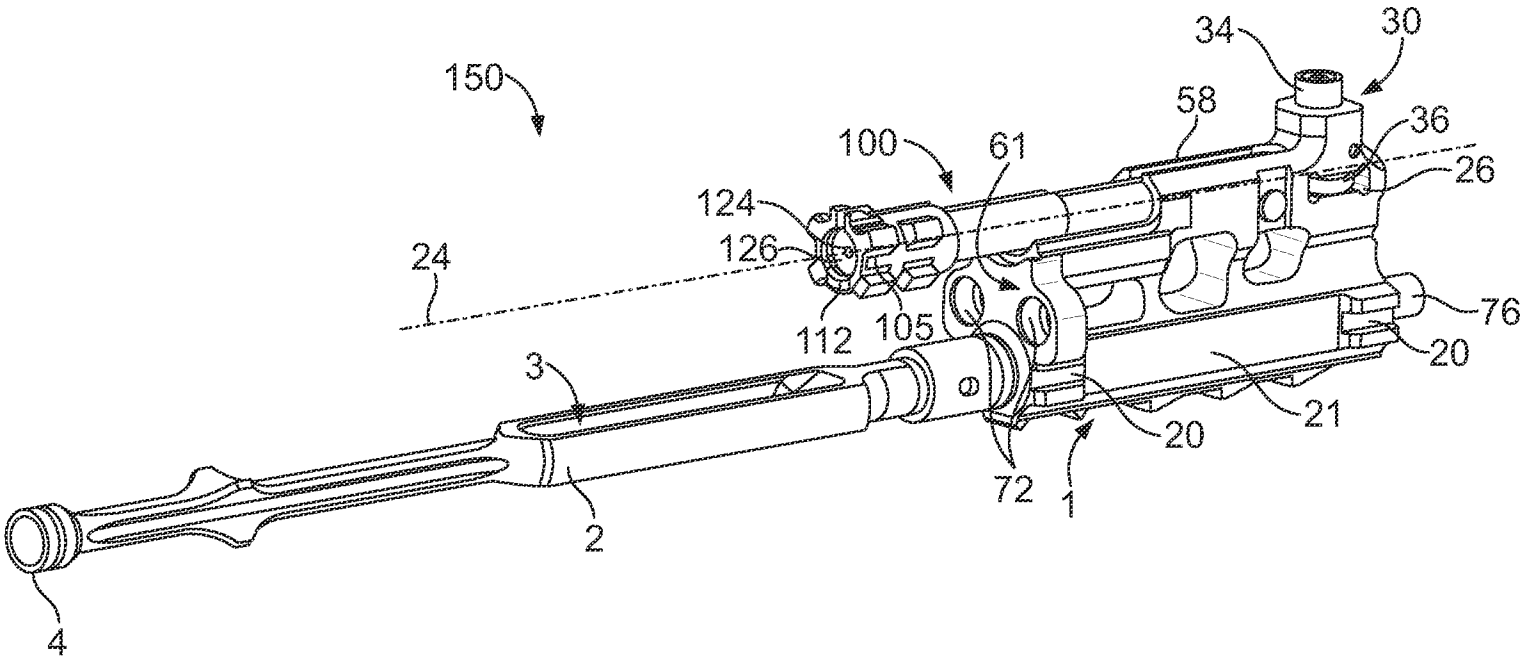
FIG. 1 depicts a perspective from the front of an example breech assembly having a rotary lug breech in accordance with the teachings of this disclosure.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity. Additionally, several examples have been described throughout this specification. Any features from any example may be included with, a replacement for, or otherwise combined with other features from other examples. Further, throughout this description, position designations such as "above," "below," "top," "forward," "rear," "left," "right," etc. are referenced to a firearm held in a normal firing position (i.e., wherein the "shooting direction" is pointed away from the marksman in a generally horizontal direction) and from the point of view of the marksman. Furthermore, the normal firing position of the weapon is always assumed, i.e., the position in which the barrel runs along a horizontal axis.

The examples disclosed herein relate to breech assemblies for use with a firearm and/or machine gun having a gas pressure loader. The example breech assembly may be a rotary lug breech having a bolt carrier and a bolt located therein. The bolt may include a plurality and/or numerous breech studs and the receiver may include a plurality and/or numerous locking lugs.

The example breech assembly disclosed herein substantially reduces actuation, guidance and/or control forces to enable firearms and/or machine guns to have a smooth firing characteristic and/or cadence. Thus, using the examples disclosed herein, firearms and/or machine guns may have an improved hit ratio and increased aiming precision. In some examples, the examples disclosed herein reduce acceleration and actuation forces acting on a rotary lug breech, thereby improving performance.

Some of the components of the examples disclosed herein are depicted in FIGS. 1-5.

An example breech assembly 150 includes a bolt carrier 1 and a gas tube, piston rod and/or rod 2 that connects a front end of the bolt carrier 1 to a gas intake (e.g., a tap at the barrel) of a weapon (e.g., firearm, machine gun, etc.). When the firearm is fired, gas pressure received via the gas intake acts on the end of a piston 4 and urges and/or moves the bolt carrier 1 via the piston rod 2. Movement of the piston rod 2 moves and/or actuates the bolt carrier 1 and/or pushes the piston 4 and/or the bolt carrier 1 in a housing, casing and/or body 6 (FIG. 3) towards the rear of the firearm and/or weapon.

In this example, the body 6 is formed by two body casings, body portions and/or elements 8 and 10. The body portions 8 and 10 include interior lower and upper guide tracks 12, 14, 16 and 18 that guide movement of the bolt carrier 1 as the bolt carrier 1 moves during the loading and/or unloading process (e.g., moves back and forth relative to the body 6).

To guide the bolt carrier 1 horizontally along a bore axis 24 (FIG. 1) while being substantially fixed in the transverse and vertical axes and/or directions, the lower guide tracks 12, 14 engage in and/or interact with first and second guide grooves 20, 22 (FIGS. 1, 2) on the left and right side of the bolt carrier 1.

An intermediate space, aperture and/or groove 21 between the first and second grooves 20 and 22 enables the bolt carrier 1 to be guided with relatively low friction and without sensitivity to contaminants. In this example, as the bolt carrier 1 moves relative to the body 6, the first and second guide grooves 20, 22 and the lower guide tracks 12, 14 interact in a claw-like manner to substantially remove contaminants from the guidance region, thereby reducing friction between the guide surfaces of the guide grooves 20, 22 and/or the guide tracks 12, 14. The first and second guide grooves 20 and 22 are provided in pairs at the front and rear ends of the bolt carrier 1 to substantially prevent the bolt carrier 1 from tilting relative to the body 6 during the loading and/or unloading process and/or to support the bolt carrier 1 along the entire length of the body 6, for example.

In some examples, a breech guide and/or guidance device 30 is positioned at an upper rear end of the bolt carrier 1. The breech guide 30 includes a guide shaft, elongated member, shaft and/or element 32 forming a carrier component that receives and/or accommodates a control and/or first roller 34 and a guide and/or second roller 36. The first roller 34 is positioned at an upper end of the guide shaft 32 and acts as a control component. The guide shaft 32 passes through the second roller 36. The second roller 36 acts as a guide component that is axially inserted into a lateral recess 26 of the bolt carrier 1. The second roller 36 is rotationally coupled to the guide shaft 32 and extends over portions and/or sides of the bolt carrier 1.

In some examples, the guide shaft 32 and the first and second rollers 34, 36 are coaxially aligned and/or positioned relative to an axis of symmetry 33 that runs perpendicularly relative to the bore axis 24. The guide shaft 32 is axially displaceable in a receptor opening and/or retaining aperture 38 of the bolt carrier 1. The guide shaft 32 is biased by a spring 40 and is movable against a force of the spring 40 into and/or relative to the retaining aperture 38.

In some examples, the axial positioning path and/or travel range of the guide shaft 32 is defined by a recess, slot and/or aperture 42 (FIG. 4) on an exterior surface of the guide shaft 32. A retaining pin and/or stop 44 passes laterally through the bolt carrier 1 and/or the guide shaft 32 and forms a stop. The guide shaft 32 is moveable and/or displaceable between upper and lower impact surfaces of the recess 42. The interaction between the retaining pin 44 and the upper and lower impact surfaces of the recess 42 substantially prevents the guide shaft 32 from being urged out of the retaining aperture 38. In some examples, the first roller 34 is rotationally coupled and/or fixed to an upper end of the guide shaft 32 by a stud, fastener and/or rivet 46 (FIG. 3) and a washer, spacer and/or retainer 48 (FIG. 3).

Figure 3:
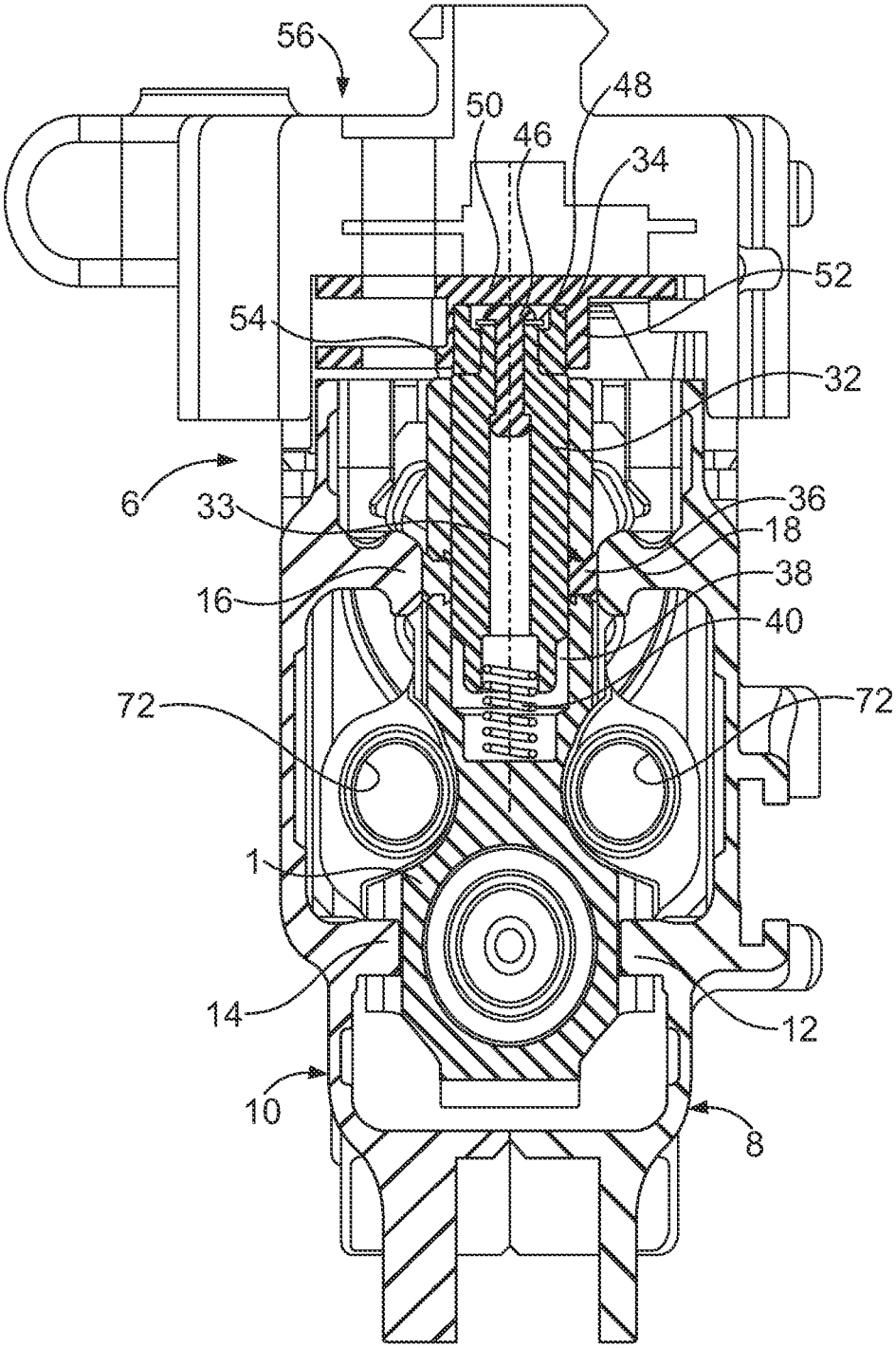
FIG. 3 depicts a cross-sectional view of an example weapon casing through a section of the example breech assembly.

In some examples, the first roller 34 engages in a U-shaped guide gate, cam and/or curved lever 50 (FIG. 3). Specifically, spherical circumferential surfaces of the first roller 34 alternatively engage on inner flanks and/or surfaces of first and second lateral arms, legs and/or portions 52, 54. To enable the lever 50 to drive a cartridge advancing mechanism as the bolt carrier 1 advances and retracts, the first roller 34 acts as an actuator cam for the bolt carrier 1 moving the lever 50 back and forth at a right angle relative to the bore axis 24. Depending on the direction of motion, the lever 50 transfers transverse forces via the arms 52, 54 to the first roller 34 through the guide shaft 32 and the bolt carrier 1. The interaction with the first roller 34 may tilt and/or urge the guide shaft 32 and/or the bolt carrier 1 transversally to the sides of the body 6 (e.g., to the left or to the right). To substantially prevent the transverse forces from limiting the guidance characteristics and/or mobility of the bolt carrier 1 along the bore axis 24, the second roller 36 having spherical surfaces transfers the transverse loads to the body 6 by rolling, interacting with and/or engaging the upper guide tracks 16, 18. The interaction between the second roller 36 and the upper guide tracks 16, 18 substantially prevents jamming and/or canting occurring between the first and second guide grooves 20, 22 and the lower guide tracks 12, 14. The functionality of the first roller 34 (e.g., control and transport function) and the interaction and/or friction between the first roller 34 and the lever 50 may minimally decelerate, slow and/or effect the motion of the bolt carrier 1 in and/or relative to the body 6.

The rollers 34, 36 may be spherical rollers to substantially ensure smooth guidance of the bolt carrier 1 relative to the body 6. In some examples, if the first arm 52 applies a left acting force on the right side of the first roller 34 via the control flank of the first arm 52, the second roller 36 rests on and/or engages the left upper guide track 16 (e.g., the first and second rollers 34, 36 move in the force direction, to the opposite side and/or to the left).

A smooth guiding function of the bolt carrier 1 relative to the body 6 may be obtained and/or ensured by sizing and/or dimensioning the spacing between inwardly facing surfaces and/or flanks of the upper guide tracks 16, 18 and inwardly facing surfaces and/or flanks of the arms 52, 54 to provide at least some play for the rollers 34, 36, for example. In some examples, surfaces of the rollers 34, 36 substantially ensure a smooth and clean rolling action along the upper guide tracks 16 and/or 18 and/or the arms 52, 54 of the lever 50 even when the bolt carrier 1 is at an angle and/or slightly tilted relative to the body 6 as the bolt carrier 1 advances and retracts. In some examples, the rollers 34, 36 may be at an angle and/or slightly tiled relative to guide flanks and/or surfaces of the upper guide tracks 16, 18 and/or inner flanks and/or surfaces of the arms 52, 54 as the rollers 34, 36 move relative thereto.

In this example, the lever 50 is positioned in and/or adjacent a cover and/or lid 56. The cover 56 may be rotatably coupled and/or rotated and opened in a hinged manner to accommodate an advance mechanism and/or belt feeder mechanism. The guide shaft 32 and the first roller 34 are retractable and/or movable into the bolt carrier 1 to enable the lever 50 to be closed in any arbitrary breech position without damaging the lever 50 and/or the first roller 34. For example, if one of the arms 52, 54 and/or ends of the arms 52, 54 engage the first roller 34, the first roller 34 and/or the guide shaft 32 are received and/or pushed into the retaining aperture 38 of the bolt carrier 1. During the loading motion of the bolt carrier 1 along the bore axis 24, based on being biased by the spring 40, an upper end surface and/or portion of the first roller 34 slides along and/or engages a lower end surface of one of the arms 52, 54 until the first roller 34 is in the track of the lever 50 and/or between the arms 52, 52.

In some examples, to improve the rolling characteristics of the first and second rollers 34, 36, the outer surfaces of the guide shaft 32 and/or inner surfaces of the rollers 34 and/or 36 have relatively smooth surfaces (e.g., through coating, machining, processing, etc.). In some examples, the first and second roller 34 and/or 36 are coupled to the guide shaft 32 by a roller bearing and/or any other suitable coupling. In some examples, roller bearings may be included adjacent the first and second guide grooves 20, 22 to reduce frictional resistance with the guide tracks 12, 14, 16 and 18 as the bolt carrier 1 moves relative to and/or in the body 6. In some examples, instead of including the first and second rollers 34, 36, displaceable control and/or guide components and/or elements may be provided that engage in a sliding manner with guide flanks and/or inner flanks of the lever 50. The guide components may be symmetrical in a folding manner with respect to a plane of symmetry defined by, spanning and/or between the bore axis 24 and the axis of symmetry 33.

Figure 2:
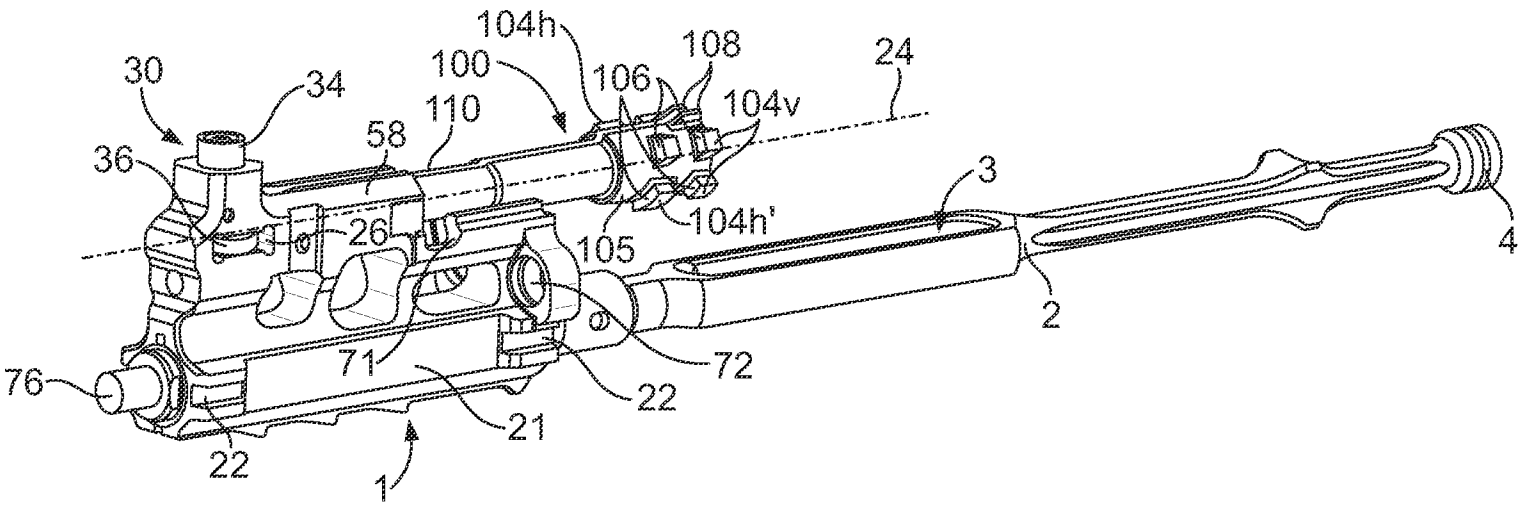
FIG. 2 depicts a perspective rear view of the example breech assembly of FIG. 1.

The example breech assembly 150 includes a rotary lug breech having an axially displaceable bolt 100. The bolt 100 is rotatably movable between a locked and released position within a guide sleeve and/or aperture 58 on an upper surface and/or portion of the bolt carrier 1. In this example, the bolt 100 includes front and/or first breech lugs and/or studs **104*v* (FIG. 2) and back and/or second breech studs 104*h* (FIG. 2). While the breech studs 104 include four circularly displaced first breech studs 104*v* and/or four circularly displaced second breech studs 104*h*, any other number of breech studs may be used instead. The breech studs 104, 104*h* are in pairs at particular positions (e.g., one and/or two o'clock positions, four and/or five o'clock positions, seven and/or eight o'clock positions and/or ten and/or eleven o'clock positions). Lateral gaps and/or grooves longitudinally extend between the breech studs 104*v*, 104*h* to enable locking with the receiver 200 and/or to guide the bolt 100 relative to the body 6**.

The example breech assembly 150 may be used with open bolt weapons in which the breech assembly 150 is positioned between the ammunition to be loaded prior to firing and, after initiating firing a shot, the breech assembly 150 advances and feeds the ammunition into the ammunition chamber and/or cartridge chamber. After the breech assembly 150 is secured and/or locked, the cartridge is fired.

FIGS. 1, 2, 4 and 5 depict the bolt 100 in the released and/or unlocked position and FIGS. **6*d*-6*f* depict the bolt 100 in the secured and/or locked position. When the breech assembly 150 is moved in and/or relative to the body 6, the upper guide tracks 16, 18 substantially prevent the bolt 100 from twisting and/or rotating. The upper guide tracks 16, 18 run in lateral gaps (e.g., at three o'clock and nine o'clock positions) between the breech studs 104*v*, 104*h***.

In some examples, feed projections, studs and/or lugs 108 are positioned at the front end of the bolt 100 at the 12 o'clock position. An ejection slot and/or cartridge ejector slot 110 runs through and/or between the feed projections 108. The feed projections 108 supply cartridges to the firearm and an ejector coupled and/or rigidly positioned on the body 6 discharges the empty, fired cartridge shells from the firearm when the bolt carrier 1 moves backwards. The feed projections 108 enable stable guidance of the cartridges when moving and/or transporting ammunition in the weapon.

Figure 4:
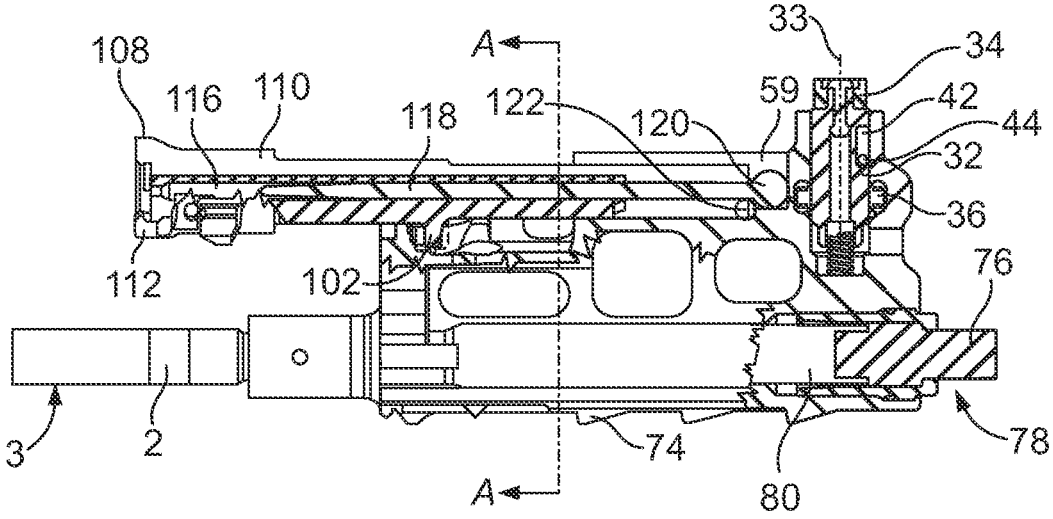
FIG. 4 depicts a longitudinal cross-sectional view of the example breech assembly of FIGS. 1 and 2.
Figure 5:
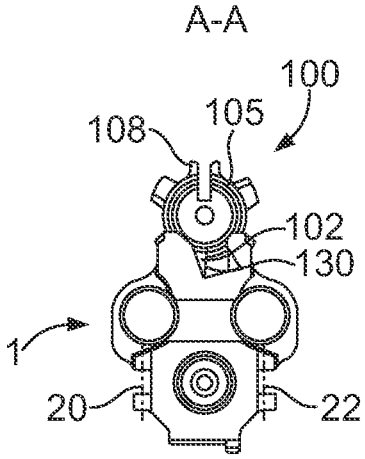
FIG. 5 depicts a cross-sectional view of the example breech assembly along A-A of FIG. 4.
Figure 6A:
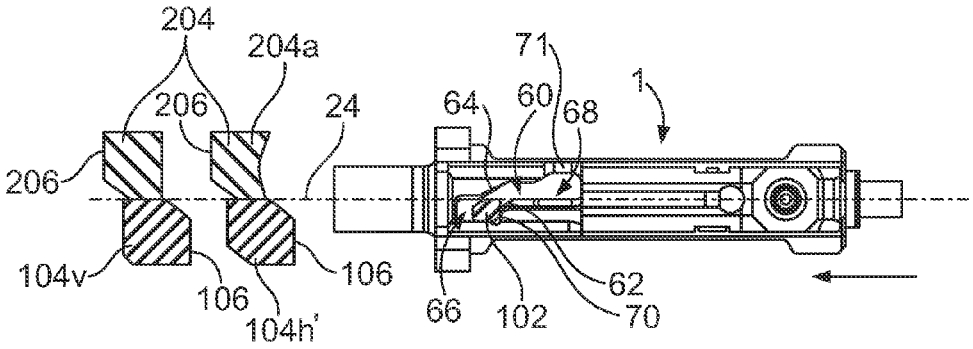
FIGS. 6*a*-6*i* and 6*k* depict schematic representations of different positions of an example breech lug and associated control pin during the locking and unlocking process.
Figure 7:
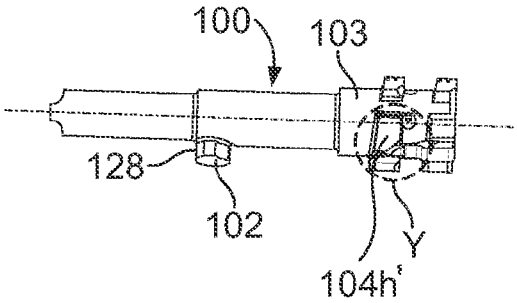
FIG. 7 depicts an example side view of an example bolt.

In some examples, as shown in FIGS. 4, 5 and 7, rotational motion of the bolt 100 and/or relative motion between the bolt 100 and the bolt carrier 1, is controlled by a control pin, extension and/or portion 102 that extends downward into a control gate, slot and/or aperture 60 (FIG. **6*a*) of the bolt carrier 1. Depending on the direction of motion of the bolt 100 and the operational state of the weapon, the control pin 102 is deflected and/or moved to different rotational positions by interacting with the slot 60. As shown in FIG. 6*a*, for example, the slot 60 includes a front linear guidance region and/or first slot portion 66 and a rear linear guidance region and/or second slot portion 68. The first and second slot portions 66, 68 are coupled and/or connected via a control flank, lower surface and/or first slot surface 62 and a control flank, upper surface and/or second slot surface 64. The first slot surface 62 may be used in the locking and/or securing process and the second slot surface 64 may be used in the unlocking and/or releasing process. A planar impact surface, impact surface and/or portion 70 is positioned at a substantially right angle relative to the bore axis 24 at rear end of the first slot portion 66. To substantially prevent angular momentum, torque and/or rotational forces from being transferred to the bolt 100 from the forward moving bolt carrier 1, the slot 60 and/or the impact surface 70 interacts with a rear end surface 128 (FIG. 7) of the control pin 102 as the bolt carrier 1** moves forward and/or advances.

In some examples, the control pin 102 includes a wedge-shaped cross-sectional profile that extends radially outwards and engages in and/or interacts with the slot 60 and/or the first and/or second slot portions 66, 68. To secure and/or substantially prevent the bolt 100 from tilting in the guide sleeve 58, lateral flanks 130 (FIG. 5) of the bolt 100 are secured and/or held via a dovetail guide, for example. As shown in FIG. 4, when the rear end of the bolt 100 is located in the guide sleeve 58 with a relatively small overlap, the bolt 100 with the extracted breech configuration cannot be accidently removed and/or pried out of the guide sleeve 58.

In some examples, to remove the bolt 100, an opening, aperture and/or removal window 71 (FIG. 6*a*) is positioned at a read end of the second slot portion 68. To remove the bolt 100, the bolt 100 may be rotated in the guide sleeve 58 which in turn rotates the control pin 102 to enable the bolt 100 to be removed forwardly from the guide sleeve 58.

In some examples, the bolt 100 defines a firing pin channel 116 (FIG. 4) coaxially aligned with the bore axis 24. A firing pin 118 is moveable, displacable, guidable, etc., in the firing pin channel 116. The firing pin 118 may include an end, rear end and/or spherical head 120 positioned in a receiving chamber and/or aperture 59. The end 120 may be axially attached and/or retained in the bolt 100 by a cross-pin and/or fastener 122. In operation, as the bolt 100 moves relative to the bolt carrier 1 during the loading and/or unloading process, the firing pin 118 moves with the bolt 100 towards the front and/or rear of the firearm. To fire a shot, the firing pin 118 passes through a firing pin opening and/or aperture 124 (FIG. 1) and extends from an impact base and/or surface 126 at the front end of the bolt 100 to strike a percussion cap of a cartridge adjacent thereto. A base of a cartridge to be fired is positioned at a front end of the bolt 100. In some examples, a spring loaded pressure pin and/or biasing element urges and/or biases an extraction claw, extractor and/or element 112 (FIG. 1) that engages an extraction groove of a cartridge. The tension, spring force and/or clamping force of the extractor 112 may be adjusted to enable the extractor 112 to, during the cartridge loading process, be outwardly rotated over a rear edge of the cartridge base and positioned in the extraction groove of the cartridge in the cartridge chamber.

During the locking procedure, the breech studs 104 on the bolt 100 interact with the locking lugs 204 on the receiver 200. During the locking process, the breech studs 104 may be received through the recesses 202 (FIG. 8) of the receiver 200 and brought into a position in which the first slot surface 62 of the slot 60 engages the control pin 102. The interaction between the control pin 102 and the first slot surface 62 turns and/or rotates the control pin 102 and brings the breech studs 104 in front of and/or in alignment with locking lugs 204 of the receiver 200. Aligning the breech studs 104 and the locking lugs 204 enables rear facing end surfaces and/or stud surfaces 106 of the breech studs 104 to engage, rest against and/or interact with forward facing end surfaces and/or lug surfaces 206 of the locking lugs 204 to lock and/or secure the bolt 100 in the linear direction and/or in the direction of and/or relative to the bore axis 24. The interaction between the breech studs 104 and the locking lugs 204 enables the bolt 100 to be substantially precisely positioned relative to the cartridge chamber at the rear end of the barrel. In some examples, the cartridge chamber is rigidly and/or coupled at defined a position relative to the receiver 200.

During the unloading and/or releasing process, the bolt carrier 1 moves relative to the bolt 100 and the second slot surface 64 of the slot 60 engages and/or interacts with the control pin 102. The interaction between the slot 60 and the control pin 102 turns and/or rotates the control pin 102 out of the locking position to enable the bolt 100 and the breech studs 104*h*, 104*v* to be moved linearly toward the rear of the firearm through the recesses 202 of the receiver 200.

Figure 8:
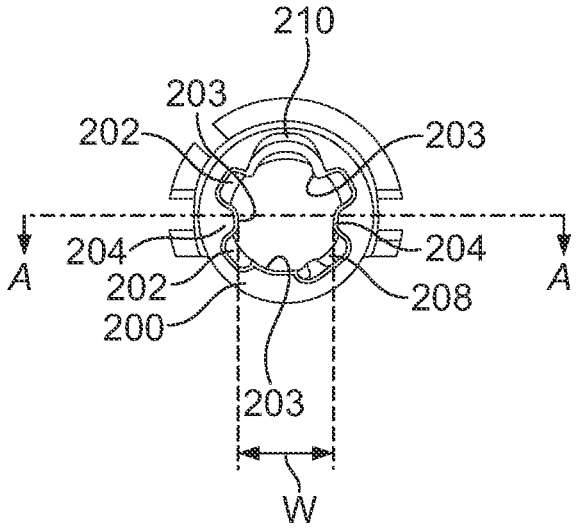
FIG. 8 depicts a rear view of an example receiver.
Figure 9:
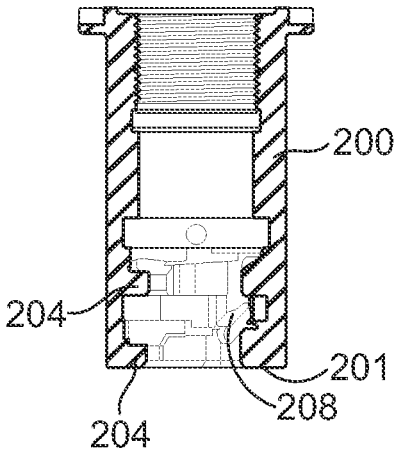
FIG. 9 depicts a cross-sectional view of the example receiver of FIG. 8 along A-A.

In some examples, to improve the locking and/or releasing of the breech assembly 150, a guide channel 209 (FIG. 6*c*) is positioned in and/or defined by the receiver 200. The guide channel 209 interacts with a control breech stud 104*h*' on the bolt 100 and extends and/or runs along a cam section, portion, cam lug surface 208 (FIGS. 6 and 8).

Figure 6B:
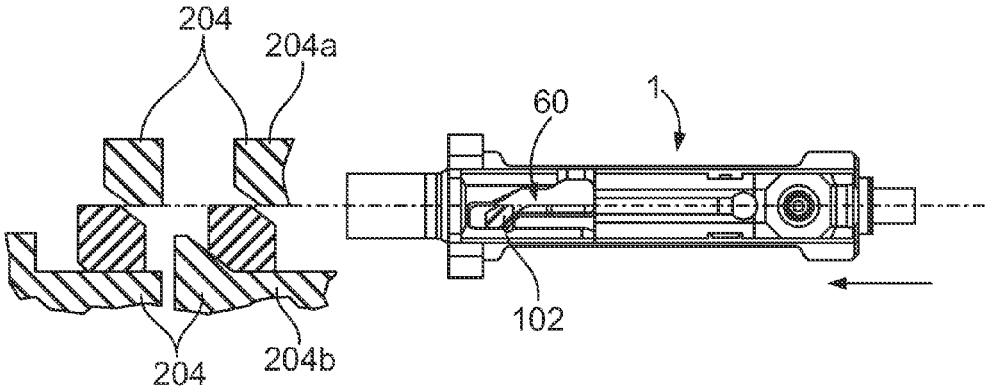
Figure 6C:
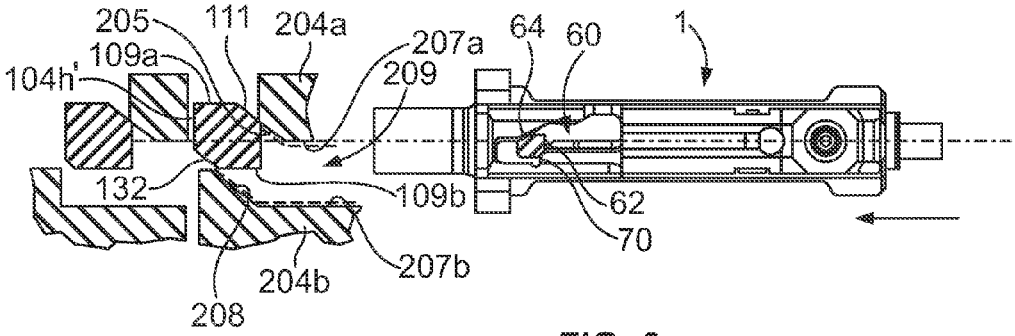
Figure 7A:
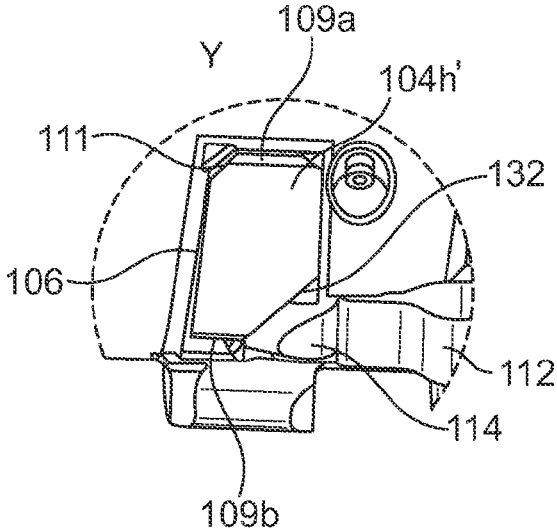
FIG. 7*a* depicts a detailed view of an example head of the bolt of area 'Y' of FIG. 7.

As shown in FIG. 6*c*, the guide channel 209 is identified by broken lines. In some examples, the guide channel 209 is defined by lateral surfaces and/or locking lugs 204*a*, 204*b*, the cam lug surface 208 and a guide lug surface and/or section 205. The locking lugs 204*a*, 204*b* are adjacent one another in the circumferential direction. The guide channel 209 guides the second breech studs 104*h* along lateral flanks and/or lug side surfaces 109*a*, 109*b* via a control section and/or first stud surface 132 (FIGS. 7*c*, 7, 7*a*) and a guide section and/or second stud surface 111 (FIGS. 7*c*, 7, 7*a*).

The examples disclosed herein and/or the example breech assembly 150 improves the cartridge extraction procedure by enabling the sequence between unloading and loading the weapon to be accomplished fluidly, smoothly undemanding and/or without imparting substantial loads and/or forces.

FIGS. 6*a*-6*k* depicts the complete cycling movement that the breech assembly 150 goes through when firing a shot and/or round. The breech studs 104, 104*h*', 104*v* and the locking lugs 204, 204*a*, 204*b* are in different positions and/or being twisted and/or rotated relative to and/or towards one another. The corresponding position of the control pin 102 in the slot 60 is shown in crosshatching (e.g., figure to the right).

When firing a shot with the firearm armed, loaded and/or cocked, the breech assembly 150 (e.g., the bolt carrier 1 and the bolt 100) is positioned toward the rear of the body 6. Loaded and/or stressed breech springs are positioned on breech spring guide rods and/or engage in, pass through and/or are adjacent to spring eyes and/or apertures 72 in the bolt carrier 1. The bolt carrier 1 includes sear catches 74 (FIG. 4) to retain the bolt carrier 1 in the rearward position. In the unlocked and/or released position, the bolt 100 is maintained and/or held in a rotational position by the upper guide tracks 16, 18. In the unlocked and/or released position, the control pin 102 is positioned in the first slot portion 66. When the breech assembly 150 is released by releasing the sear catches 74, the breech assembly 150 advances under the effect of the breech springs in a direction of the arrow (FIGS. 6*a*-6*e*).

As shown in FIG. 6*a*, when feeding a cartridge, the feed projections 108 engage a lower edge of a cartridge on a belt, remove the cartridge from the belt and guide the cartridge forward via the motion of the breech assembly 150 through the receiver 200 into a cartridge chamber of a barrel. The cartridge chamber and/or the cartridge is secured in the receiver. When the feed projections 108 engage and/or meet a base and/or end of the cartridge, the bolt 100 is moved and/or pushed rearwardly into the bolt carrier 1. Moving the bolt 100 toward the rear moves the control pin 102 in the slot 60 from the first slot portion 66 toward the rear to engage and/or impact the impact surface 70. The breech studs 104 are received in the recesses 202 between the locking lugs 204 as the breech studs 104 move into the receiver 200. The receiver 200 includes a feed ramp 210 (FIG. 210) on an upper surface that feeds and/or guides cartridges as the cartridges are moved and/or pushed into the cartridge chamber of the barrel during the loading process. During the loading process, the control breech stud 104*h*' is received and/or inserted into the guide channel 209 and guided in an axial manner via an interaction between first and second lug surfaces and/or lateral flanks 207*a*, 207*b* and first and second stud surfaces and/or lateral flanks 109*a*, 109*b*.

Figure 6D:
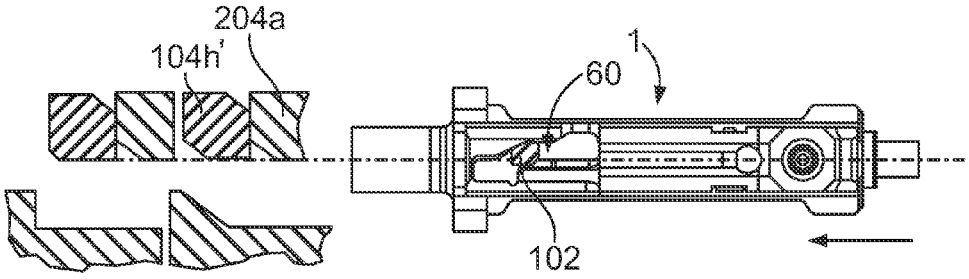
Figure 6E:
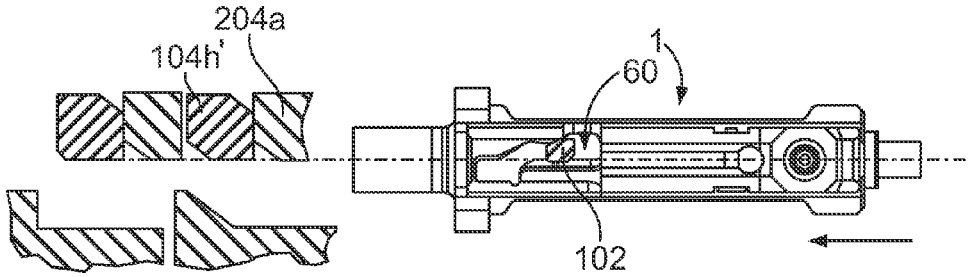

When locking the breech, as shown in FIG. 6*b*-6*d*, in this example, the bolt 100 is guided and/or advances from the upper guide tracks 16, 18 in the body 6 in a form locking manner. In some examples, the bolt 100 exits and/or over runs the upper guide tracks 16, 18 enabling the first breech studs 104*v* to be received by the locking lugs 204 of the receiver 200. As the bolt 100 further advances when locking the breach, the second breech stud 104*h* exits and/or overruns the upper guide tracks 16, 18.

In some examples, the bolt 100 remains in the unlocked position until the control breech stud 104*h*' and/or the first stud surface 132 impacts the cam section 208 (FIG. 8) of the receiver 200, thereby transferring angular momentum and/or torque to the bolt 100 and rotating and/or turning the bolt 100 via the breech stud 104 counterclockwise approximately one third of the total rotation. The interaction between the first stud surface 132 and/or the second stud surface 111 of the control breech stud 104*h*' and the cam section 208 of the guide channel 209 between the locking lugs 204*a*, 204*b* guides the control breech stud 104*h*'.

In some examples, one-sided arrival of the first stud surface 132 of the control breech stud 104*h*' at the cam section 208 of the control locking lugs 204*b* causes the bolt 100 to load on one side and/or deviate in a direction transverse to the bore axis 24 and jam.

In some examples, to substantially prevent the bolt 100 from deviating and/or tilting during the locking and/or loading process, an outer diameter of the cylindrical shaft surface and/or breach head surface 105 (FIGS. 1, 2 and 5) between the breech studs 103 is aligned with and/or corresponds to a bore 'w' inner diameter between the radially inward directed head surfaces 203 of the locking lugs 204 (FIG. 8). During the loading process, the cylindrical shaft surface 105 interacts with and/or rests against the corresponding head surfaces 203 of the locking lugs 204. Because of the interaction between the head surface 203 and the breech stud 104, the bolt 100 is introduced axially into the receiver 200 substantially without tilting and transfers the forward motion into rotational motion without significant friction loss. As such, the bolt 100 can be locked in position in the receiver 200.

In the locking process, the rear impact surface 128 of the control pin 102 protrudes from and/or leaves the impact surface 70 of the slot 60. During the locking process, the first slot surface 62 used for locking in the slot 60 engages a corresponding control surface of the control pin 102, which is introduced and/or initiated by the interaction between and/or introduction of the relative motion between the cam section 208 and the first stud surface 132. In some examples, to lock the bolt 100 relative to the receiver 200, the first slot surface 62 interacts with and/or locks against the corresponding control surface of the control pin 102 to twist and/or rotate the bolt 100 further into its locking position.

During the locking process, the cartridge base engages and/or lies entirely on the impact base 126 of the bolt 100 and the extractor 112 snaps into and/or over the corresponding extraction groove on the end of the cartridge.

In some examples, by further rotating the bolt 100, the breech studs 104 arrive in front of and/or are positioned adjacent to the locking lugs 204 and the stud surfaces 106 of the breech studs 104 are positioned adjacent to, in front of and/or behind the lug surfaces 206 of the locking lugs 204. When the breech studs 104 are positioned adjacent the locking lugs 204, the bolt 100 further rotates approximately two thirds of the total rotation.

In some examples, the stud surfaces 106 and the lug surfaces 206 are inclined and/or tilted at a self-locking angle relative to the bore axis 24. The remainder of the locking of the bolt 100 may result from a screwing motion and/or interaction between the breech studs 104 and the locking lugs 204. The surface coupling between the breech studs 104 and the locking lugs 204 may be self-locking such that an axial effect to the bolt 100 does not result in the breech studs 104 shifting from and/or releasing from the locked position.

The locking process described above relates to the pre-control and/or initial locking process and the final and/or definitive locking process. In the initial locking process, the interaction between the cam section 208 and the first stud surface 132 causes the bolt 100 to rotate one third of the total rotation and, in the final locking process, locking the breech 100 occurs in a substantially and/or extremely smooth manner without strong recoil motions. In some examples, the incline and/or interaction between the stud and lug surfaces 106, 206 enables the locking process and reduces inner frictional resistance. In some examples, the incline and/or angle of the cam section 208 corresponds to the incline and/or angle of the first stud surface 132 and the incline and/or angle of the guide section 205 corresponds to the incline and/or angle of the first slot surface 62 to enable locking and/or movement of the control pin 102 and/or the bolt 100 to occur smoothly. In some examples, the angle of the first slot surface 62 relative to the angle of the cam section 208 is selected to enable the rotational acceleration of the bolt 100 to increase during the locking process. In some examples, the angle of the first slot surface 62 is similar to the angle of the cam section 208.

In some examples, the angle of the first slot surface 62 corresponds to the angle of the second slot surface 62 to enable the control pin 102 to move through the entire length of the slot 60 and particularly the first and second slot surfaces 62, 64 with little play.

When firing a shot and discharging a cartridge, as shown in FIG. 6*d*, the control pin 102 is positioned at the forward end of the second slot portion 68 and the bolt 100 is positioned in the receiver 200 in a linear orientation and locked at its circumference. When the bolt 100 is secured, the bolt carrier 1 moves forward relative to the bolt 100 and urges the firing pin 118 forward in the firing pin channel 116, out through the firing pin opening 124 to engage and cause a cartridge to discharge. During the firing process, the control pin 102 moves in the second slot portion 68 relative to the breech carrier 1, towards the rear of the firearm until the front end surface 61 of the bolt carrier 1 meets and/or engages the rear facing end surface 201 of the receiver 200 and the forward motion of the breech carrier 1 stops. The interaction between the bolt carrier 1 and the receiver 200 interrupts and/or stops the movement of the bolt carrier 1.

Figure 6F:
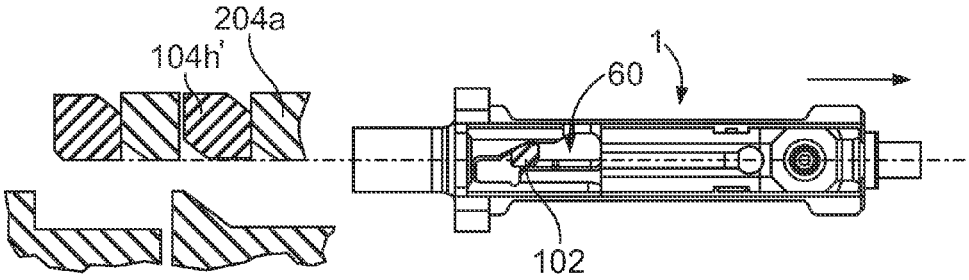

After firing a shot and/or cartridge, due to the gas pressure acting on the piston 4, the bolt 100 is urged and/or moved backwards toward the rear of the firearm and/or in the direction of the arrows in FIGS. 6*f*-6*k*. As the bolt 100 moves rearwardly, the firing pin 118 is retracted back into the firing pin channel 116 via head 120. As the bolt 100 moves backwards, the control pin 102 is positioned toward the front of the second slot portion 68 and engages the second slot surface 64 used for releasing and/or unlocking (FIG. 6*f*).

Figure 6G:
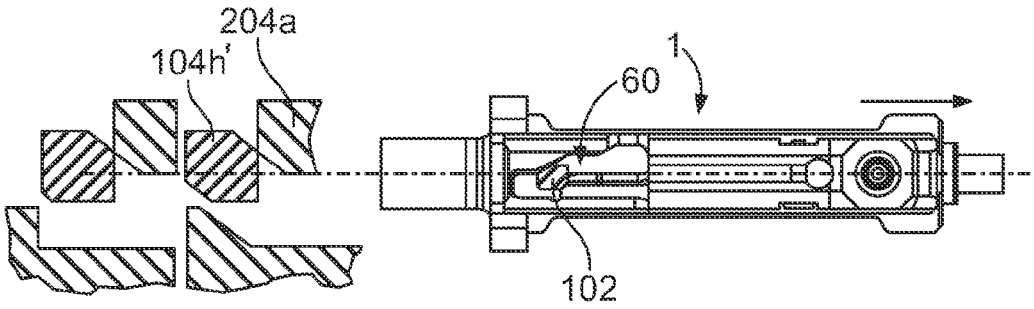
Figure 6H:
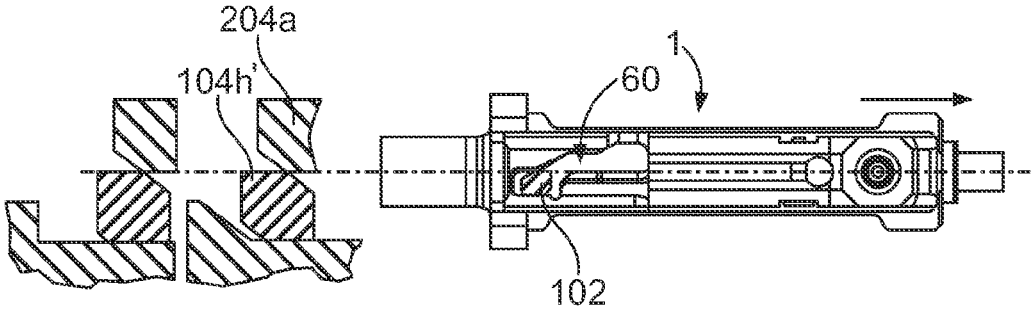

When releasing and extracting the cartridge, as shown in FIGS. 6*f*-6*h*, the releasing movement and/or motion of the bolt 100 causes the breech studs 104 to be rotated out of the region of the locking lugs (FIG. 6*g*). The unlocking motion may decrease the pressure between the impact base 126 and the end of the cartridge shell and the extractor 112 can rotate the cartridge shell via the extraction groove. The rotational movement of the bolt may be caused by the interaction between the second slot surface 64 and the control pin 102. After a shot is fired, in some examples, the cartridge shell may expand and become securely jammed in the cartridge chamber of the barrel. During the unlocking motion, the first stud surface 132 rests against the cam section 208 and the cartridge shell may be pulled and/or removed from the cartridge chamber with an increased force and reduced axial speed (from the positions shown in FIG. 6*g* to the position shown in FIG. 6*h*).

Similar to the locking process, as the bolt 100 is being unlocked, the control breech stud 104*h*' is guided by the first stud surface 132 and the second stud surface 111 interacting with the cam section 208 of the locking lugs 204*b* and the guide surfaces 205 of the locking lugs 204*a* in the guide channel 209.

Figure 6I:
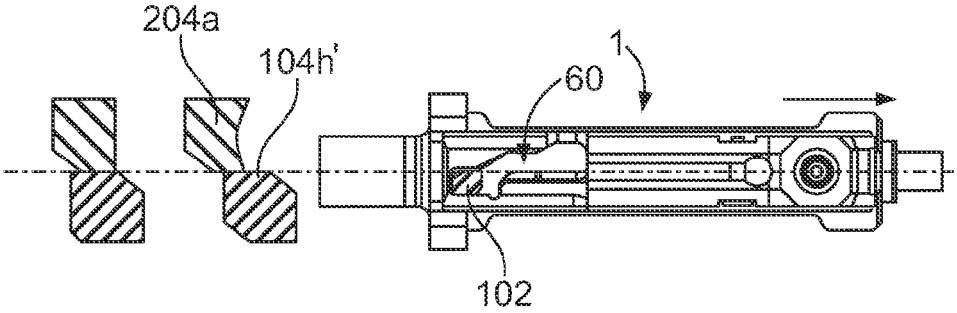
Figure 6K:
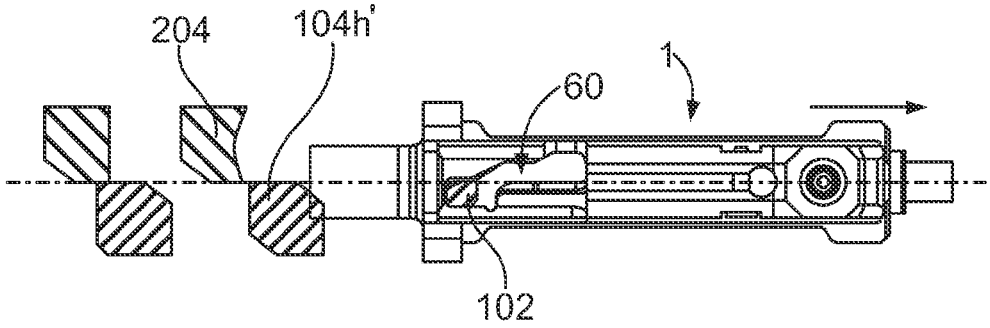

In the completely rotated position, the breech studs 104 are aligned with the recesses of the receiver 200 and the control pin 102 engages and/or pushes against a front end of the first slot portion 66. With the extractor 112 grasping the cartridge shell, the bolt 100 is guided rearwardly away from the bolt carrier 1 toward the rear of the firearm (FIG. 6*i*). As the bolt 100 and the bolt carrier 1 move rearwardly, the cartridge shell is removed from the cartridge chamber and the receiver 200 (FIG. 6*k*).

As the bolt carrier 1 and the bolt 100 move rearwardly, the bolt 100 is positioned adjacent the upper guide tracks 16, 18 and the ejector that extends from the ejector slot 110 pushes the cartridge shell downward through the window, aperture and/or opening 3 of the piston rod 2 and out of the firearm. As the bolt carrier 1 moves further toward the rear of the firearm, the bolt carrier 1 engages a stopping pin and/or stop 76 (FIG. 1) on a base plate of the weapon. The stop 76 may be positioned at a lower region and/or area of the bolt carrier 1 and may be an extension of the piston rod 2.

In some examples, the stop 76 is cushioned in the interior of the bolt carrier 1 by a mechanical buffer and/or buffer 78. The buffer 78 may absorb a relatively high degree of mechanical energy using an annular spring and/or biasing element 80 that smoothly absorbs a relatively high portion of the kinetic energy from the breech assembly 150 with limited recoil. Upon releasing the trigger and/or firing the last round from a magazine and/or belt, the breech assembly 150 is secured in the locked position via the sear catch 74.

As set forth herein, the function of releasing cartridges from a cartridge chamber of a barrel is not controlled exclusively by the relative motion between the bolt and the bolt carrier. Instead and as disclosed herein, the cam section 208 of the receiver 200 acts and/or interacts with the first stud surface 132 on the bolt 100.

When releasing the bolt 100, the rotational motion of the bolt 100 is converted into a screwing motion based on the relative motion and/or interaction between the bolt carrier 1 and the bolt 100 and/or between the slot 60 and the control pin 102 in which the first stud surface 132 of the bolt 100 interacts with and/or acts together with the cam section 208 of the receiver 200 to control the screwing motion and/or movement of the bolt 100.

The screwing motion and/or movement of the bolt 100 guides the bolt 100 out of the receiver 200. In the unloading process, the cam section 208 acts as a wedge on which the first stud surface 132 of the bolt 100 rests. During the loading process, the torque and/or movement transferred to the control pin 102 via the slot 60 is converted in part to a traction force and/or used to smoothly and/or easily remove a deformed cartridge shell from a cartridge chamber after firing even if the cartridge is tightly lodged and/or wedged in the cartridge chamber. Before the bolt 100 is positioned in the fully rotated position, the bolt 100 is linearly moved and/or pulled from the bolt carrier 1 rearwardly out of the receiver 200.

Loosening the cartridge from the cartridge chamber enables a fired cartridge to be gently released and/or removed from the cartridge chamber in a linear, decelerated motion. With the appropriate selection and/or configuration of the angle, pitch and/or falling gradient of the cam section 208, the first and second slot surfaces 62 and/or 64 of the slot 60, loosening the cartridge from the cartridge chamber enables, leverage to be generated with increased force that enables even a tightly lodged and/or heavily deformed cartridge shell to be removed from the cartridge chamber.

In some examples, the extractor 112 is substantially protected in its primary function, thereby increasing the useful life of the extractor 112.

The examples disclosed herein enable the extraction force to be smoothly transferred to the cartridge base via the extractor 112, thereby reducing the possibility and/or risk of the cartridge base of a significantly deformed cartridge shell being torn off by the returning breech assembly 150 causing the remaining portion of the cartridge shell to become lodged in the cartridge chamber.

Using the examples disclosed herein, the firing characteristics of firearms implementing the example breech assemblies may be substantially smoother and more reliable. As disclosed herein, to increase the ease of manufacturability, the cam section 208 may be positioned on the locking lug 204 and the first stud surface 132 may be position on the breech stud 132. Thus, the examples disclosed may not include additional structures then may typically be included to enable receiver and/or bolt adjustments.

In some examples, the cam section 208 of the receiver 200 is positioned and/or structured to twist, rotate and/or control the control pin 102 during the locking and/or loading process of the bolt 100. The control section 208 may be structured to enable the impact surface 70 of the slot 60 of the bolt carrier 1 and/or the slot 60 of the bolt carrier 1 during the loading process to exert an angular momentum and/or torque on the bolt 100 via the control pin 102 that turns the bolt 100 relative to the receiver 200 and brings the bolt 100 into its end and/or locking position. The pre-control ability of the example breech assembly 150 increases reliability and/or improves handling characteristics of the weapon.

As disclosed herein, the bolt 100 is axially guided in the receiver 200 via the cylindrical shaft surface 105 in the forward region and/or the inwardly facing head surfaces 203 of the locking lugs 204, which may intercept, absorb and/or substantially prevent the transverse forces acting on the bolt 100 in the loading and/or unloading processes. In some examples, the locking lugs 204 support the bolt 100 such that the bolt 100 is guided without twisting into the receiver 200 and/or the bolt carrier 1 to enable the control, pre-control, loading and/or unloading processes to occur with relatively low internal friction. Thus, even with lower cadences, a sufficient amount of energy is produced via in the piston rod 2 of the breech assembly 150 for the belt transport, the belt removal, feeding ammunition and/or removing and/or discarding shells.

As disclosed herein, the angular momentum and/or torque and/or rotational force of the advancing bolt carrier and/or breech 1 is substantially not transferred to the bolt 100 before the locking procedure. The bolt carrier 1 may be advanced and/or moved relative to the receiver 200 without substantial force on the body 6 of the weapon and/or the guide tracks 12, 14, 16 and/or 18. In some examples, the guide tracks 12, 14, 16 and/or 18 engage in and/or interact with the gaps between the breech studs 104 in the lateral flanks 130 of the bolt 100 to substantially ensure that the bolt 100 is not inadvertently twisted when entering the receiver 200 and/or jam. The interaction between the guide tracks 12, 14, 16 and/or 18 and the breech studs 104 especially in rotary lug breeches having multiple rows substantially ensures that the bolt 100 is entirely insertable into the receiver 200 before being rotated to the locking position therein.

As disclosed herein, the breech assembly 150 substantially optimizes the breech function, the action between the bolt 100 and the receiver 200 and/or between the bolt 100, the bolt carrier 1, the slot 60 and/or the control pin 102.

As disclosed herein, the stud and lug surfaces 106, 206 of the locking lugs 204 and/or the breech studs 104 are angled and/or have a pitch to enable the final locking and/or loading process and/or the primary release and/or unloading process to occur on a helical track having a limited pitch instead of being on a plane. Having the stud and lug surfaces 106, 206 angled and/or pitched enables during the releasing and/or unloading process for a cartridge to be introduced into the cartridge chamber in a reliable manner and for the bolt 100 to be precisely positioned relative to the cartridge chamber. Using the examples disclosed herein, the recoil effects at the end of the locking motion may be reduced. Using the examples disclosed herein, the cartridge may be introduced into the cartridge chamber in a reliable manner and the bolt 100 may be precisely and/or accurately positioned behind and/or relative to the cartridge chamber. Using the examples disclosed herein, the recoil effects at the end of the locking motion may be reduced.

In the unloading and/or releasing process, substantially no restricting frictional effect between the impact base 126 and the cartridge base occurs because the incline and/or angle of the stud and lug surfaces 106, 206 enables during the releasing process the stud and lug surfaces 105, 206 to separate from one another and/or the impact base 126 to be separated from the cartridge base. Using the examples disclosed herein, the bolt 100 can move with the extractor 112 engaging an end of the cartridge shell with the releasing motion substantially unimpeded by frictional forces between the impact base 126 and the cartridge base and/or between the locked and/or interacting stud and lug surfaces 106, 206. More specifically, using the examples disclosed herein, the bolt 100 can arrive at the partially released position before the cam section 208 and the control section of the cartridge shell is removed and/or levered out of the cartridge chamber.

As disclosed herein, the multiple rows of breech studs 104 enables the breech assembly 150 to have a relative compact and slender design and have relatively large locking surfaces on the stud and lug surfaces 106, 206 of the breech studs 104 and locking lugs 204.

As disclosed herein, to further improve guidance of the bolt 100 during locking and/or unlocking, the guide channel 209 is positioned adjacent two locking lugs 204*a*, 204*b* and at least partially defined by corresponding surfaces 205, 207*a*, 208 and/or 207*b*. During the loading and/or unloading processes, the surfaces 111, 109*a*, 132 and/or 109*b* of the control breech stud 104*h*' engages in and/or with the surfaces 205, 207*a*, 208 and/or 207*b* of the locking lugs 204*a*, 204*b*. The interaction between the locking lugs 204*a*, 240*b* and the control breech stud 104*h*' enables the control breech stud 104*h*' to be guided with a predetermined tolerance and/or play relative to and/or in the guide channel 209 and for the breech assembly 150, the bolt 100 and/or the bolt carrier 1 to transition between rotational and axial motion during the locking process and between rotation and axial motion during the unlocking process. In some examples, the breech studs 104 enable the recoil effects during the motion transitions to be neutralized and the flow of motion not to be substantially affected.

In some examples, the guide channel 209 is formed and/or defined by the lateral surfaces 207*a*, 207*b* of the locking lugs 204*a*, 204*b*, the cam section 208 of the locking lug 204*b* and the guide surface 205 of the locking lug 204*b* facing the cam section 208. The guide channel 209 enables the control breech stud 104*h*' to be guided in a substantially controlled manner between guide surfaces. For example, the control breech stud 104*h*' may be guided between lateral surfaces of the locking lugs 204*a*, 204*b* and/or between the cam section 208 of the locking lug 204*b* and the guide surface 205 of the locking lug 204*a*. Using the examples disclosed herein, the pre-control motion during locking and the extraction screwing motion (e.g., a lift function) are reliably controlled.

As disclosed herein, the breech lugs 204 improve the guidance effect of the breech assembly 150, for example.

In some examples, the interaction between the control pin 102 and the slot 60 substantially improves the guidance of the bolt 100 in the firearm and/or substantially ensures that the bolt 100 in an extracted breech configuration cannot be inadvertently and/or violently leveraged from its seat, coupling and/or position relative to the bolt carrier 1 to an advanced position that would damage the coupling with the bolt carrier 1.

In some examples, the bolt 100 includes the feed projections 109 separated by the ejector slot 110 on an upper surface of the bolt 100 to enable cartridges to be released from the cartridge belt and transported and/or moved to the cartridge chamber. The extractor 112 may be centrally positioned in the firearm and may advance fired and/or empty cartridge shells downwardly through the ejector slot 110.

As disclosed herein, the locking lugs 204 improve the guidance characteristics of the bolt assembly 150 and/or the bolt 100 in the body 6 and/or substantially prevent inadvertent rotational motion of the bolt 100 when the bolt 100 is outside of and/or at a distance from the receiver 200.

In some examples, the breech guide 30 improves the motion and/or movement characteristics of the breech assembly 150 and/or the advancement of cartridges using the example breech assembly 150 by reducing frictional forces between the bolt carrier 1, the body 6 and/or the bolt 100.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A rotary lug breech, comprising:

a bolt carrier including a slot;

a bolt at least partially positioned in the bolt carrier, the bolt comprises a plurality of breech studs;

a receiver comprising a plurality of locking lugs, wherein one of the locking lugs comprises a cam section, wherein when releasing the bolt during an unlocking process, the cam section converts a releasing motion into a screwing motion to release a cartridge from a cartridge chamber using the bolt, wherein during the screwing motion, a first stud surface is supported on the cam section, during a locking process, the first stud surface engages the cam section to perform a pre-control process that rotates a control pin in the slot of the bolt carrier from a releasing position in which an advancement of the bolt carrier exerts substantially no torque on the bolt, to a control position in which a first slot surface of the slot interacts with the control pin, when the bolt carrier moves forward with the bolt during the locking process, the bolt carrier exerts a torque on the bolt to convert linear motion of the bolt into a locking motion via a screwing motion in which the bolt and the bolt carrier move relative to one another.

2. The rotary lug breech of claim 1, wherein the breech studs radially extend from a substantially cylindrical shaft surface of the bolt.

3. The rotary lug breech of claim 2, wherein an outer diameter of the substantially cylindrical shaft surface is to be aligned with a bore between inward radially facing head surfaces of the locking lugs, the head surfaces to axially guide the substantially cylindrical shaft surface to limit lateral displacement of the bolt when the bolt performs the locking and unlocking processes within the receiver.

4. The rotary lug breech of claim 1, wherein the control pin is to be in a releasing position when the bolt carrier advances in which a rear end surface of the control pin engages an impact surface of the slot, the impact surface to be substantially transverse to an axis of a bore to enable the bolt carrier to exert substantially no torque on the bolt.

5. The rotary lug breech of claim 1, wherein end surfaces of the locking lugs and the breech studs have a helical inclination relative to an axis of a bore to enable a self-limiting threading effect to be obtained between the end surfaces.

6. The rotary lug breech of claim 1, wherein the breech lugs comprise a first breech lug row and a second breech lug row, the first breech lug row behind the second breech lug row.

7. The rotary lug breech of claim 1, wherein the locking lugs comprise a first locking lug row and a second locking lug row, the first locking lug row behind the second locking lug row.

8. The rotary lug breech of claim 1, wherein first and second adjacent locking lugs comprise functional surfaces that define a guide channel that are to engage and guide corresponding functional surfaces of a control breech stud during the locking and unlocking processes.

9. The rotary lug breech of claim 8, wherein the guide channel comprises lateral surfaces of the first and second locking lugs, the cam section of the first locking lug and a guide surface of the second locking lug, wherein the guide surface faces the cam section and the lateral surfaces face one another.

10. The rotary lug breech of claim 9, wherein the guide surface is to face diagonally toward a front of a weapon.

11. The rotary lug breech of claim 9, wherein the control breech stud comprises a guide section that is to correspond to the guide surface.

12. The rotary lug breech of claim 11, wherein the guide section is to face diagonally toward a rear of the weapon.

13. The rotary lug breech of claim 1, wherein the control pin comprises a wedge-shaped radially outward extending cross-section, wherein in a released position, the control pin is substantially radially fixed in a corresponding wedge-shaped guide groove of the slot to enable the bolt to be substantially secured relative to the bolt carrier in the released position.

14. The rotary lug breech of claim 1, where the bolt comprises feed projections separated by an ejector slot, wherein when the bolt carrier advances, the feed projections are to be located behind an available cartridge at a cartridge base to feed the available cartridge into a cartridge chamber.

15. The rotary lug breech of claim 1, wherein the bolt comprises recesses adjacent the breech lugs along an axis of a bore, guide tracks of the bolt carrier to interact with the recesses to axially secure the bolt about a circumference of the bolt when one or more of the bolt or the bolt carrier moves in a body of a weapon.

16. The rotary lug breech of claim 1, further comprising:

a shaft positioned within the bolt carrier;

a first roller on the shaft;

a second roller on the shaft, wherein the second roller is to guide the bolt carrier along guide tracks, wherein the shaft comprises an axis of symmetry substantially perpendicular to an axis of a bore, the first and second rollers coaxially positioned on the shaft.

17. A firearm, comprising:

a bolt carrier;

a bolt at least partially positioned in the bolt carrier, the bolt comprises a plurality of breech studs;

a receiver comprising a plurality of locking lugs, wherein one of the locking lugs comprises a cam section, wherein when releasing the bolt during an unlocking process, the cam section converts a releasing motion into a screwing motion to release a cartridge from a cartridge chamber using the bolt, wherein during the screwing motion, a first stud surface is supported on the cam section, during a locking process, the first stud surface engages the cam section to perform a pre-control process that rotates a control pin in a slot of the bolt carrier from a releasing position in which an advancement of the bolt carrier exerts substantially no torque on the bolt, to a control position in which a first slot surface of the slot interacts with the control pin, when the bolt carrier moves forward with the bolt during the locking process, the bolt carrier exerts a torque on the bolt to convert linear motion of the bolt into a locking motion via a screwing motion in which the bolt and the bolt carrier move relative to one another.

18. A rotary lug breech, comprising:

a bolt carrier;

a bolt to be at least partially positioned in the bolt carrier, the bolt comprises a plurality of breech studs;

a shaft movably positioned within the bolt carrier, the shaft being different than the bolt carrier;

a first roller on the shaft;

a second roller on the shaft, wherein the second roller is to guide the bolt carrier along guide tracks, wherein the shaft comprises an axis of symmetry to be substantially perpendicular to an axis of a bore, the first and second rollers coaxially positioned on the shaft;

wherein when releasing the bolt during an unlocking process, a cam section of a receiver converts a releasing motion into a screwing motion to release a cartridge from a cartridge chamber, wherein during the screwing motion, a first stud surface interacts with the cam section, during a locking process, the first stud surface engages the cam section to perform a pre-control process that rotates a control pin in a slot of the bolt carrier from a releasing position in which an advancement of the bolt carrier exerts substantially no torque on the bolt, to a control position in which a first slot surface of the slot interacts with the control pin, when the bolt carrier moves forward with the bolt during the locking process, the bolt carrier exerts a torque on the bolt to convert linear motion of the bolt into a locking motion via a screwing motion in which the bolt and the bolt carrier move relative to one another.

19. The rotary lug breech of claim 18, wherein the breech studs radially extend from a substantially cylindrical shaft surface of the bolt.

* * * * *